US006305471B1

(12) United States Patent
Milloy

(10) Patent No.: US 6,305,471 B1
(45) Date of Patent: Oct. 23, 2001

(54) PRESSURE CONTROL APPARATUS

(75) Inventor: Gordon Thomas Milloy, Aberdeen (GB)

(73) Assignee: Elmar Services, Ltd. (GB)

( * ) Notice: Subject to any disclaimer, the term of this patent is extended or adjusted under 35 U.S.C. 154(b) by 0 days.

(21) Appl. No.: 09/191,152

(22) Filed: Nov. 12, 1998

(30) Foreign Application Priority Data

May 19, 1998 (GB) ..... 9810683

(51) Int. Cl.[7] ..... E21B 44/00
(52) U.S. Cl. ..... 166/250.15; 166/53; 166/65.1
(58) Field of Search ..... 166/250.15, 386, 166/53, 65.1, 66, 77.1, 89.1

(56) References Cited

U.S. PATENT DOCUMENTS

| | | | | |
|---|---|---|---|---|
| 4,794,534 | * | 12/1988 | Millheim | 364/420 |
| 4,916,617 | * | 4/1990 | Norwood | 364/422 |
| 5,054,995 | * | 10/1991 | Haseley et al. | 415/17 |
| 5,132,904 | | 7/1992 | Lamp | 364/422 |
| 5,172,717 | * | 12/1992 | Boyle et al. | 137/155 |
| 5,191,937 | | 3/1993 | Cook, Sr. | 166/363 |
| 5,273,112 | * | 12/1993 | Schultz | 166/374 |
| 5,385,207 | * | 1/1995 | Cook, Sr. | 166/53 |
| 5,691,712 | * | 11/1997 | Meek et al. | 166/65.1 |
| 5,721,538 | * | 2/1998 | Tubel et al. | 340/853.4 |
| 5,941,305 | * | 8/1999 | Thrasher et al. | 166/53 |
| 5,955,666 | * | 9/1999 | Mullins | 73/152.18 |
| 6,012,015 | * | 1/2000 | Tubel | 702/6 |
| 6,029,951 | * | 2/2000 | Guggari | 254/269 |
| 6,045,333 | * | 4/2000 | Breit | 417/44.1 |
| 6,082,454 | * | 7/2000 | Tubel | 166/250.15 |

FOREIGN PATENT DOCUMENTS

| | | |
|---|---|---|
| 0604156A1 | 6/1994 | (EP) . |
| 1559419A | 1/1980 | (GB) . |
| 2233365 * | 1/1991 | (GB) . |

* cited by examiner

*Primary Examiner*—David Bagnell
*Assistant Examiner*—Nathan Mammen
(74) *Attorney, Agent, or Firm*—Steven F. Caserza; Flehr Hohbach Test Albritton & Herbert LLP

(57) ABSTRACT

A pressure control apparatus for use with wireline pressure equipment. The pressure control apparatus has a first portion which may be located in close proximity to the wireline pressure equipment. The first portion has at least one fluid pressure outlet and at least one controlling mechanism to facilitate control of the fluid pressure outlet. The controlling mechanism is operable by a control system, at least a portion of which is located remote from the first portion in, for instance a control cabin. Also, a method of controlling pressure equipment used in the exploration, production and/or exploitation of hydrocarbons and a regulating device.

33 Claims, 3 Drawing Sheets

PRESSURE CONTROL APPARATUS

The present invention provides a pressure control apparatus, a regulating device and a method, and more particularly relates to a wireline pressure control apparatus, and a method of controlling pressure equipment used in the exploration, production and/or exploitation of hydrocarbons.

BACKGROUND OF THE INVENTION

Conventionally, when wireline pressure equipment, such as a wireline blow-out preventer (BOP), is installed as part of a drill or production string which extends downwardly from a drilling rig or the like, a standard wireline pressure skid is used to control such equipment. The wireline pressure skid is generally located on the floor of the drilling rig and has a number of valves which control the fluid pressure applied to such equipment. These controls need to be monitored and possibly changed at frequent intervals by an operator located at the skid. No-one else has control over the skid, unless they are adjacent to it.

In addition, existing systems do not allow automatic control of wireline grease injection pressure. This pressure requires adjustment when a wireline is being run into, or out of, a well. Any variations in cable speed or well pressure will result in the wireline grease injection pressure having to be adjusted.

SUMMARY OF THE INVENTION

In accordance with a first aspect of the present invention, there is provided a pressure control apparatus comprising a first portion having at least one fluid pressure outlet and at least one controlling mechanism to facilitate control of the fluid pressure outlet, wherein the controlling mechanism is operable by a control system at least a portion of which is located remote from the first portion.

Typically, the control system comprises a first controller located remote from the first portion, a second controller located at the first portion, and a telemetry system for transmitting control signals from the first controller to the second controller.

Typically, the first portion comprises a frame and may further include any one, or combination, of pumps, tanks, control valves and/or hoses.

There is typically provided a plurality of controlling mechanisms to facilitate control of a plurality of fluid pressure outlets.

The first controller typically comprises a personal computer. The computer is typically pre-loaded with software which allows a user to change the settings of the controlling mechanisms.

The second controller typically comprises a programmable logic controller (PLC).

The software typically allows the settings to be adjusted manually. Alternatively, the settings may be adjusted automatically. Typically, the software instructs the computer to display analogue gauges on a visual display unit (VDU), where the analogue gauges relate to the settings of the control mechanism. Alternatively, the gauges may be displayed in digital form. In addition, the software may allow the readings on the gauges to be sampled periodically. The samples may be recorded either in electronic form or in nonelectronic form.

The telemetry system typically comprises a transmitter unit electrically connected to the controller, a receiver unit electrically connected to the controlling mechanisms, and a transmission medium for communicating signals between the transmitter and receiver.

The transmission medium typically comprises fibre-optic or copper cables. Alternatively, the transmission medium may be electromagnetic waves, such as radiowaves, microwaves or the like.

Typically, the controlling mechanisms operate using low power electronics. The electronics are preferably powered by at least one rechargeable battery. The battery may be recharged externally, such as by a solar cell, or typically a plurality of solar cells, or by an air powered generator. Preferably, the skid will operate for up to 6 days without changing the batteries.

The controlling mechanisms are typically actuated by at least one air valve. The air valves are preferably piezo electric air valves. These help reduce electrical power consumption. The air valves typically facilitate operation of a hydraulic circuit.

The fluid pressure outlets are typically coupled to pressure equipment. Such pressure equipment operated by the apparatus typically includes any of the following:

i) flow tube and BOP grease injection system;

ii) BOP, tool trap, tool catcher and line wiper;

iii) Stuffing box;

iv) Glycol inject;

v) Master valve; and vi) Downhole safety valve.

The pressure equipment may be wireline pressure equipment.

Typically, the controlling mechanisms are divided into a plurality of channels. Each channel typically operates a single piece of pressure equipment. This allows the system to be modularised, thereby increasing the versatility of the apparatus. In addition, the apparatus may be tailored to suit specific requirements where certain pressure equipment is required, and other equipment not. Consequently, costs savings may be made.

The controller mechanisms are preferably provided with full manual control. This will allow the system to operate in the event of an electronic or communications failure.

Typically, the frame comprises a pressure control skid. Alternatively, the frame may be a diesel-driven intensifier skid. Preferably, the pressure control apparatus is a wireline pressure control apparatus, and typically, the pressure control skid is a wireline control skid.

In accordance with a second aspect of the present invention there is provided a regulating means comprising an air inlet, an air outlet, and air flow control means between the inlet and the outlet to control the flow of air therebetween, characterised in that the air flow control means is operable by air pressure.

The air flow control means typically comprises a piston which is moveable between an inoperable and an operable state, to facilitate movement of a control device. The degree of operation of the piston is typically variable between the operative and non-operative state. Application of air pressure to the piston typically moves it to the operable state and thus facilitates movement of the control device. The piston is typically spring-loaded. Thus, when the air pressure is removed, the piston returns to the inoperable state.

The prevention device typically abuts against a shoulder, thus preventing passage of air between the inlet and the outlet, in the inoperable state. In the operable state, application of air pressure to the piston moves it thereby moving the prevention device away from the shoulder, thus allowing air to flow between the inlet and outlet.

In a preferred embodiment, the air flow control means typically comprises a spring loaded piston which acts against a spring loaded valve, both the piston and the valve typically being located in a housing. Typically, a diaphragm is positioned between the piston and the valve. The valve is typically coupled to the diaphragm.

Typically, the regulating means includes a second air inlet. The air pressure in the second air inlet typically exerts a force against the piston, which in turn exerts a force on the valve (typically via movement of the diaphragm), thus allowing air to flow through the regulator.

Typically, the pressure exerted by the air in the second inlet is sufficient to overcome the force exerted by the springs of the piston and the valve. Typically also, the force exerted by the air need not be constant and/or continuous.

Preferably, air pressure in the second inlet is directly proportional to the air pressure at the air outlet.

Thus, the regulating means provides continuous air pressure at the air outlet, the pressure of which is controllable by a pilot air pressure.

BRIEF DESCRIPTION OF THE DRAWINGS

Embodiments of the present invention will now be described, by way of example only, with reference to the accompanying drawings in which.

DESCRIPTION OF A PREFERRED EMBODIMENT

Figure 1:
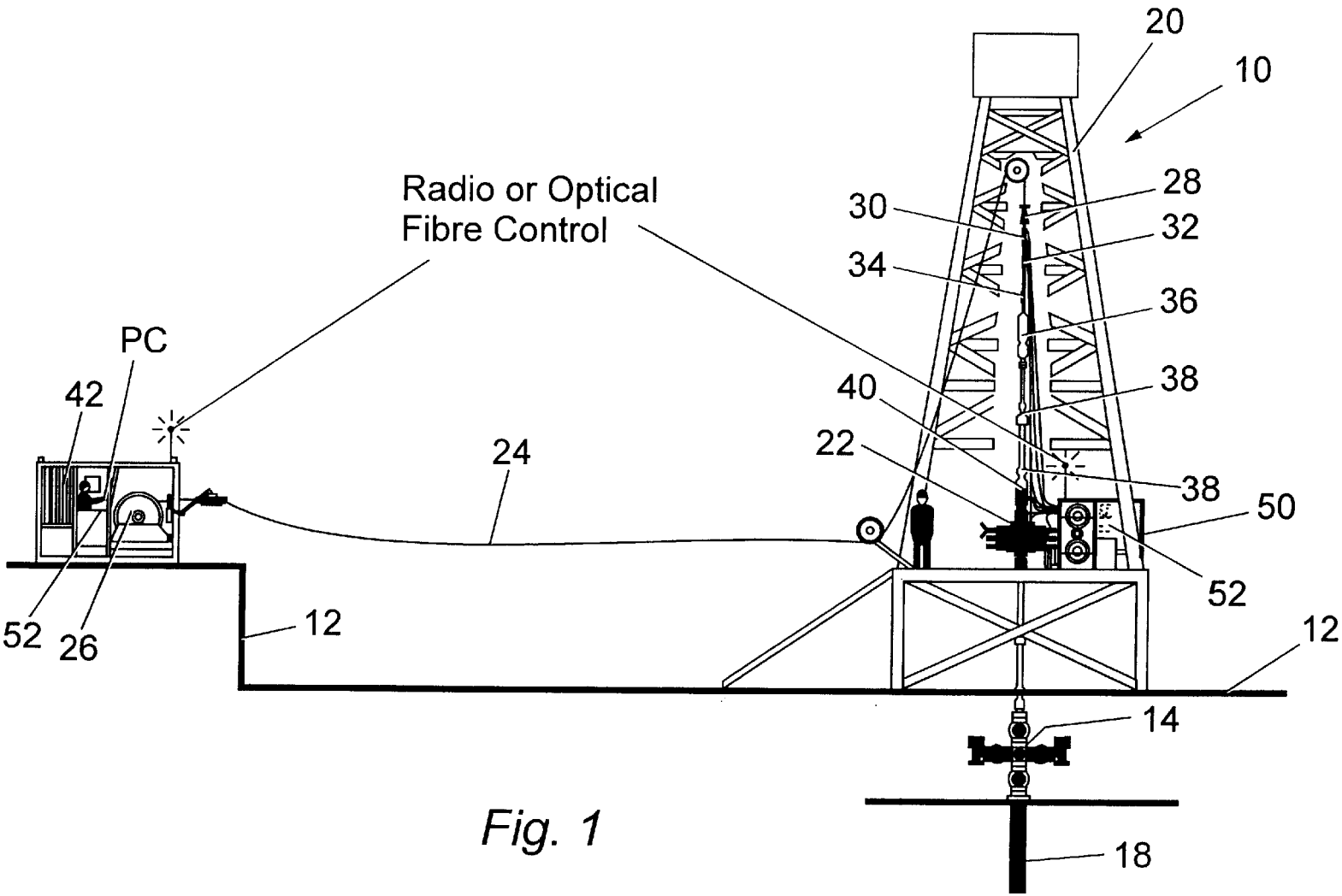
FIG. 1 is a schematic view of a typical wireline apparatus incorporating the present invention.

FIG. 1 shows a typical wireline and drilling apparatus 10. The apparatus 10 may be located on land, or alternatively, on a drill rig floor 12 suspended above sea level using a suitable rig structure or platform. The apparatus 10 is in fluid communication with a well head 14. Below the well head 14 may be a casing string 18, or alternatively, there could be a drill string, tubing or coiled tubing, depending upon the stage of hydrocarbon recovery.

The apparatus 10 includes a derrick structure 20. Suspended from the derrick 20 is a typical wireline pressure control apparatus which includes a blow-out preventer (BOP) 22 which is usually energised by hydraulic pressure. A wireline BOP 22 is a device which controls formation pressure in a well by sealing the annulus around a drill pipe or a wireline when the pipe or wireline is suspended in the hole, or alternatively by sealing across the entire hole if no pipe or wireline is in it.

Mounted on the derrick 20 is a pulley system through which a wireline 24 is fed. The wireline 24 is generally a long, narrow wire wound on a storage drum 26 which is used for well logging/perforating and other downhole operations. A variety of devices for measuring downhole conditions can be attached to the wireline 24.

As the wireline 24 is pulled out of the borehole, it will collect contaminants such as oil and grease. Such contaminants should be removed to keep the area clean and safe. Thus, a line wiper 28 is used to clean the wireline as it is spooled. The line wiper 28 generally consists of a plurality of rubber rings which can be energised using hydraulic pressure. By carefully controlling this pressure, the rings may be gently brought into contact with the wireline 24, thereby wiping the line 24 as it moves therethrough. The contaminants are directed down grease return line 100 into a collection or holding tank 78. It should be noted that the holding tank 78 (as shown schematically in FIG. 2) is referenced in a number of places in FIG. 2, although only one tank is provided.

Mounted below the wireline wiper 28 is a stuffing box 30. It generally consists of a plurality of rubber rings which can be energised by applying hydraulic pressure, similar to the line wiper 28. The rubber rings close around the wireline 24, thereby creating a fluid seal.

To allow the wireline 24 to move within the apparatus 10 smoothly and with the least amount of friction possible, grease is used to provide lubrication. More importantly, the grease seals around the wireline 24 which runs through close fitting flow tubes, thereby holding back the well pressure. Thus, a grease return 32 and a grease inject 34 are located below the stuffing box 30. The grease inject 34 is used to inject grease into the apparatus 10 and is normally hydraulically controlled, where the hydraulic controls are conventionally located on a pressure control skid.

Conventionally, the injection of grease is monitored and controlled by an operator located adjacent the hydraulic controls. The job of the operator is to manually dial in the pressure at which it it required to inject grease at, based on the well pressure. However, this requires one operator to be in close attendance at all times, purely to monitor the grease injection and/or well pressure.

The grease return 32 is closed off if the flow down the return line 100 becomes excessive. If the grease seal is lost, hydrocarbons are forced out of the well at high pressure. These hydrocarbons will go down the grease return line 100 and past the line wiper 28. Thus, if the grease seal is lost, the wireline 24 is stopped and the grease return 32 and the stuffing box 30 are closed to contain the hydrocarbons. At the same time, more grease is injected into the apparatus 10 in an attempt to contain the hydrocarbons.

Below the grease inject 34 is a head catcher 36. The head catcher 36, or tool catcher as it also known, is a hydraulic collar which is actuated to close around the head of a tool. The catcher 36 is used to prevent a tool which is being retracted from the well, from being dropped into the well if it hits the top of the catcher 36 and the wireline 24 breaks.

One (or more) lubricators 38 are mounted below the catcher 36, and two lubricators 38 are shown in FIG. 1. The lubricators 38 are hollow tubes, the diameter of which must be sufficient to allow the range of electronic and non-electronic tools to be passed therethrough.

A tool trap 40 is located between the BOP 22 and the lubricators 38. The trap 40 has a hydraulically operated flap which may be opened and closed. The tool sits on the flap of the trap 40 whilst it is being picked up. Once the tool is located by the catcher 36, the trap 40 is then opened allowing it to pass into the well.

In order to control the various pressures and functionality of this equipment, a wireline pressure control skid 50 in accordance with a first aspect of the present invention is used. The skid 50 has a plurality of fluid outlets which are monitored by analogue gauges which show the pressures in the line. Each outlet is associated with one type of pressure equipment, such as that described above. Conventionally, an operator must be located adjacent this skid to monitor and adjust these pressures.

However, the control skid 50 of the present invention may be controlled remotely. Thus, the operator normally required at the control skid 50 is not necessary and may be assigned to other duties or the number of personnel required on the apparatus 10 reduced accordingly.

Located as part of the skid 50 is a control panel and a computing means (not shown). The computing means may take pressure signals from the well and automatically adjusts the grease injection pressure accordingly. The pressure in the well is measured, and the grease injector 32 is set to inject grease at a higher pressure, say 20% above well pressure. This percentage may be varied if required. Thus, if the well pressure increases, the grease injection pressure increase. Conversely, if the well pressure decreases, so does the grease injection pressure.

Figure 2:
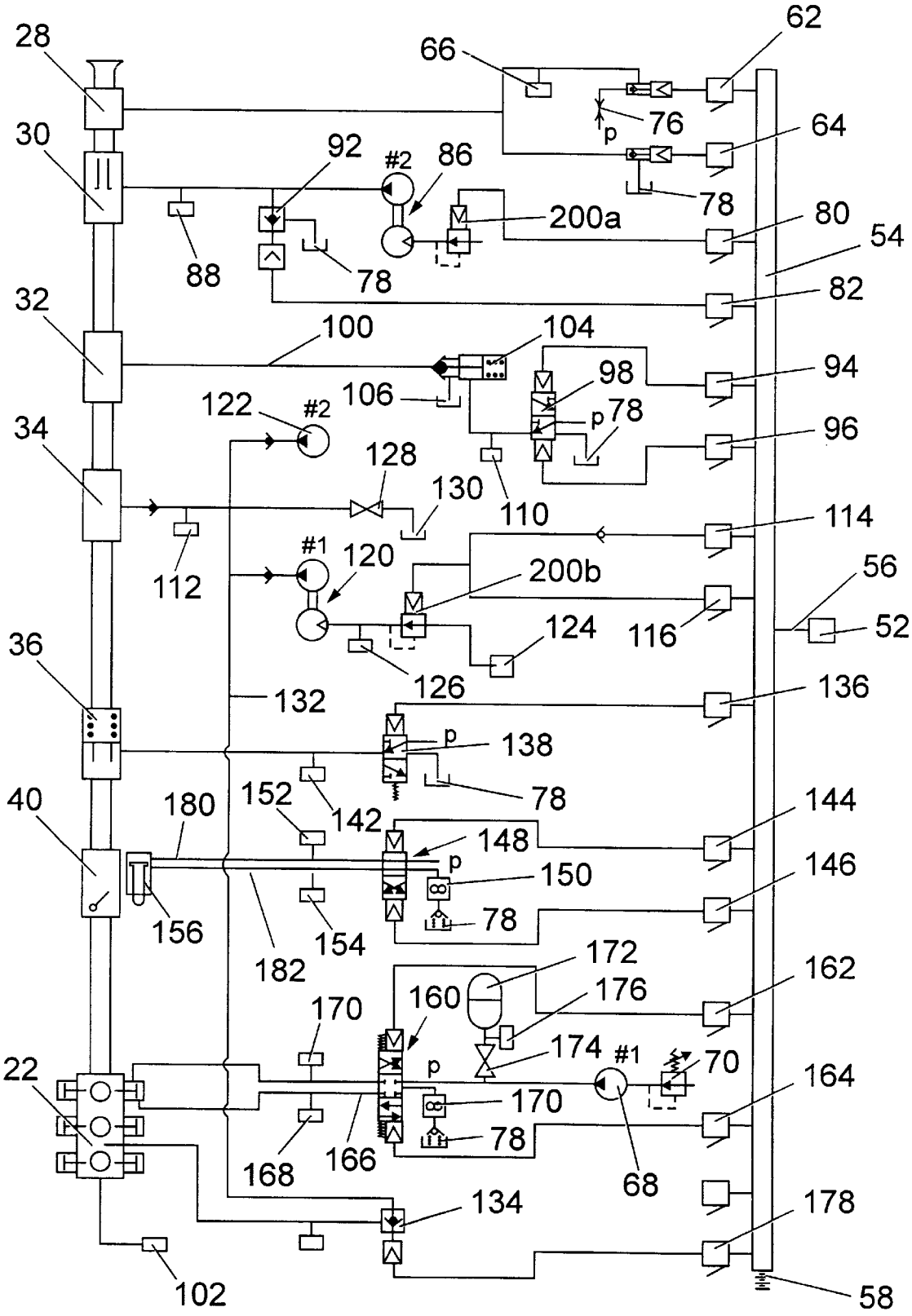
FIG. 2 is a schematic view of the hydraulic and electrical connections of the wireline pressure control apparatus of the present invention.

FIG. 2 is a schematic diagram of an exemplary control system for a wireline pressure control skid 50 which may be operated by remote control. The operation of the skid 50 is monitored and controlled by bespoke software on a personal computer (PC) 52. In FIG. 1, the PC 52 is shown located in the winchroom 42. It will be appreciated that the PC 52 may be located at any suitable position. The PC 52 is advantageously located in the winchroom 42 on the rig and is operated by the winchman.

The PC 52 is in communication with a programmable logic controller (PLC) 54 mounted on the skid 50. Between the PC 52 and the PLC 54 is a telemetry system, shown schematically in FIG. 2 as 56. The telemetry system 56 may comprise a fibre-optic cable running from the PC 52 to the skid 50. This would however require a cable to be laid between them, although there is very little or no power drain using fibre-optics. A higher data rate may be achieved with fibre-optics at the required lower power level.

Alternatively, the telemetry system 56 may comprise an electromagnetic wave communication system. This may use radiowaves, microwaves or the like. The use of radio waves is preferred, as this does not require cables to be laid between the PC 52 and the skid 50. However, there will be a power drain. Any electromagnetic wave communication system, such as radiowaves, must be explosion proof. It would also be advantageous to be switched to conserve power.

Power for the system is provided by a battery supply 58. Thus, drain on the battery 58 is of consideration. The battery 58 is used to power low power, zone 1 electronics and is preferably rechargeable. The battery 58 may be externally rechargeable by solar cells, or an air powered generator, for example. It would be advantageous if the battery 58 could provide power to the skid for periods of up to 6 days without requiring a recharge.

The PLC 54 has a number of connections to piezo electric air valves. Piezo electric air valves are used as they operate at low power, thus saving on battery power. A typical example of a valve which may be used is a Piezo 2000 valve, manufactured by Hoerbiger. The valves facilitate control of a channel which is associated with a particular piece of pressure equipment. It should be noted that the PLC 54 may be manually controlled by an operator in the event of an electronics failure. The piezo electric valves operate air circuits, which in turn control the hydraulic systems.

Each channel generally has its own pump system as they all work on different pressures and/or fluids. Each channel also requires a feedback system to adjust and control the flow and pressure of the fluids.

The channel for the line wiper 28 has two piezo electric valves 62, 64. Valve 62 is used to increase the pressure and valve 64 is used to decrease it. The pressure of the hydraulic fluid supplied to the line wiper 28 is generally finely controlled, as too much pressure causes the rubber rings within the wiper 28 to close tightly around the line 24, which is undesirable. The purpose of the wiper 28 is to gently wipe the line 24, not to grip it.

To increase the pressure, valve 62 is pulsed for a short duration. This pulse increases the pressure by a few psi until the pressure is just enough to close the rubber rings around the wire 24 to facilitate wiping thereof. The pressure is monitored by a pressure transducer 66, the signal from which is fed back to the PC 52 to allow adjustments to be made accordingly.

The hydraulic fluid pressure may be supplied from a common source (labelled as P). The pressure P is generated by a hydraulic pump 68. A regulator 70 provides a constant air input to the pump 68. The pressure at P is generally set to be of the order of 1500 psi. However, some of the wireline pressure equipment requires a higher pressure than this and individual hydraulic pumps may be used where necessary.

The transducer 66 has low power loss and may be integral with the hose which supplies the hydraulic pressure. The electric cable for the transducer is wrapped in the outer sheath of the hose.

The pressure P for the line wiper 28 is fed through a flow restrictor 76 so that the pressure flow to the line wiper 28 can be finely and accurately controlled. If the valve 64 is closed, the hydraulic fluid pressure supplied to the wiper 28 is reduced by dumping the hydraulic fluid into the tank 78.

Hydraulic fluid pressure to the stuffing box 30 may be controlled using valves 80 and 82. Closing valve 80 feeds air pressure through a regulating means in the form of a modified dome-loaded regulator 200*a* (shown as 200 in FIG. 3) in accordance with a second aspect of the present invention. The modified regulator 200*a* is required as conventional ones which use a threaded stud to control the flow of air from the air inlet to the outlet, tend to have a small air leakage which is unacceptable for this application. It should be noted that, preferably, all regulating means used are of the modified type. The regulating means 200 has an enclosed volume and thus has no air leakage.

Figure 3:
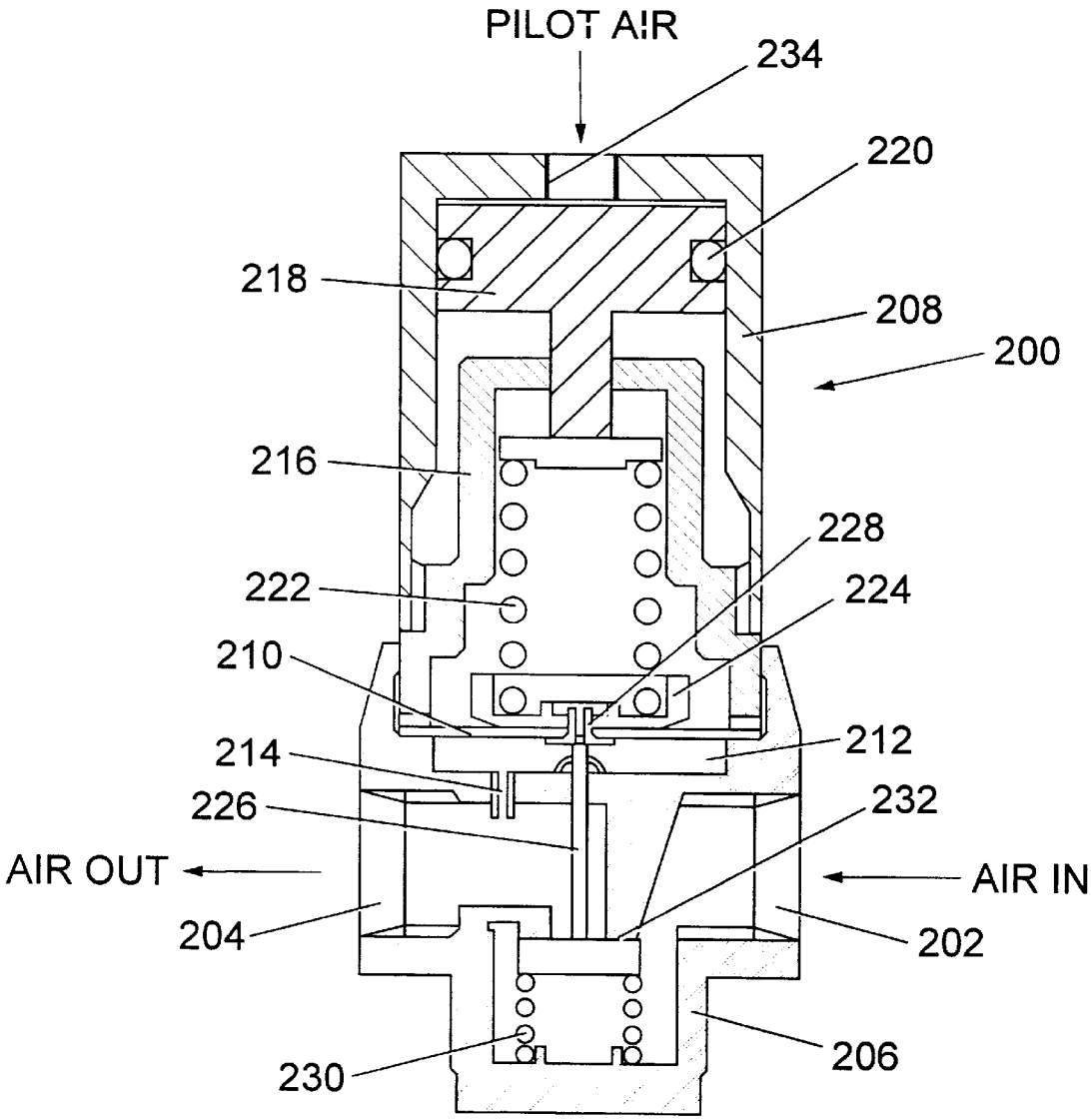
FIG. 3 is a sectional elevation of a regulating means in accordance with a second aspect of the present invention.

Referring now to FIG. 3, the regulating means 200 (used for both regulators 200*a* and 200*b* in FIG. 2) includes an air inlet 202 and an air outlet 204. The flow of air between the inlet 202 and outlet 204 is controllable by a pilot air pressure, introduced through an aperture 234. The inlet 202 and outlet 204 are formed in a regulator body 206. The body 206 is a standard regulator body used in conventional screw-adjusted regulator.

Mounted above the regulator body 206 is a cap 208, the body 206 and cap 208 being separated by a diaphragm 210. A retaining member 216 holds the diaphragm 210 in place and also provides support for a piston 218 which is mounted within the cap 208. The cap 208 and piston 218 are advantageously manufactured from brass.

To provide a measure of the pressure at the air outlet 204, a small proportion of the air in the outlet 204 is passed through an aperture 214 into a chamber 212 below the diaphragm 210.

The piston 218 is provided with a sealing means in the form of an O-ring 220 and is biased upwardly by a spring 222. The spring 222 is held in position by a locating member 224 which is coupled to an upper face of diaphragm 210.

A valve 226 is coupled to a lower face of diaphragm 210 and the locating member 224, by a centralising seat 228. Thus, movement of the piston 218 downwardly facilitates downward movement of valve 226. The valve 226 is similarly biased upwards by a spring 230, an upper face of the lower end of valve 226 thus abutting against a shoulder 232 of the regulator body 206, as shown in the configuration of FIG. 3. When the valve 226 abuts against the shoulder 232, air cannot flow between the inlet 202 and the outlet 204.

To allow the air to flow through the regulating means 200, a relatively small pilot air pressure is applied through aperture 234 in the brass cap 208. The pilot air pressure causes a downward movement of the piston 218. Consequently, the valve 226 also moves downward, thus moving away from the shoulder 232 and allowing air to flow through the regulator 200.

The resilience of the springs 222, 230 is chosen so that a given pilot air pressure applied to the piston 218 results in a given pressure of air at the outlet 204. Thus, the pilot air pressure produces a directly proportional pressure at the output of the regulator 200.

It should be noted that the pilot air pressure need not be a continuous flow of air. However, the pressure supplied through aperture 234 must be continuous for the duration of time over which the regulator 200 is to be operated.

The regulator 200*a* supplies air to a hydraulic pump 86. The pump 86 is used, as the hydraulic pressure P supplied by the pump 68 is not sufficient to control the stuffing box 30. Thus, the hydraulic pump 86 boosts the pressure P up to the required level. A pressure transducer 88 is used to monitor the pressure at the stuffing box 30. The signal from the transducer 88 is used to control and monitor the pressure at the stuffing box 30, at the PC 52.

Valve 82 can be pulsed to reduce the pressure to the stuffing box 30. The pressure is dumped into tank 78 through a one way valve 92.

Valves 94, 96 control the pressure to the grease return 32. Pulsing valve 96 connects pressure P to the grease return 32 via a three-way valve 98. This would close off the grease return 32 in the event of a well blow-out.

In a well blow-out, high-pressure hydrocarbons will flow down conduit 100, which is dangerous to personnel and equipment. To prevent this, a valve 104 is connected in line with conduit 100. In normal operation, valve 104 may be operated to divert the flow of hydrocarbons which may flow up conduit 100 into the holding tank 78. During loss of the grease seal, the high pressure hydrocarbons are blocked by valve 104.

Valve 94 may be pulsed to operate the three-way hydraulic valve 98 which operates the grease return valve 104. A pressure transducer 110 monitors the pressure to the grease return valve 104 and informs the operator of the PC 52 if the valve 104 is open or closed.

Perhaps the most important function of the control skid 50 is the operation of the grease inject 34. To work effectively, the grease channel requires several pieces of information, which are generally as follows:

i) grease pressure at the end of the hose, connected to the flow tubes;

ii) wellhead pressure;

iii) pump flow rate and cycles per minute;

iv) grease pressure at the pump output;

v) grease tank level;

vi) input air pressure; and vii) wireline speed and direction.

The computing means which forms part of the control panel on the skid 50, may monitor the grease pressure at the hose end using a pressure transducer 112. The grease inject pressure can then be automatically adjusted to be, say, 20% above well pressure. The pressure in the well may be monitored using a wellhead pressure transducer 102. This percentage may be varied if required. As the PC is used to automatically control and adjust the grease inject 34, this part of the over-all system may be stand-alone with no connection back to the winchroom 42. This would at least give more control than conventional systems which operate from a fixed input air pressure which does not compensate for the extra pressure drop along the hoses as flow increases.

However, using all of the available information and transmitting it back to the winchroom 42, provides warnings to the operator of the wireline 24 (the winchman) to slow the speed of wireline 24 if the injection rate cannot be increased further. The information may also be used to remotely control the injection pressure of grease into the well.

Referring again to FIG. 2, the grease inject channel has two piezo electric valves 114, 116. Actuation of valve 116 increases the pressure, and actuation of valve 114 decreases the pressure. The valves 114, 116 operate a second modified dome-loaded regulator 200*b*, which drives a first hydraulic pump 120. A second hydraulic pump 122 is used as a back-up in case the first pump 120 fails. It should be noted that the control system for the second pump 122 has been omitted for clarity, but is the same as that for the first pump 120. The two grease pumps 120, 122 may be operated either individually or simultaneously.

The valves 114, 116 are pulsed until the pressure measured at the transducer 112 is at the required percentage above well pressure, measured by transducer 102.

A pressure transducer 124 in the main air line monitors the air pressure fed into the regulator 200*b*. A second transducer 126 monitors the pressure which is being fed into the hydraulic pump 120. These pressures may be fed back to the PC 52 to allow the grease inject 34 to be operated effectively.

The grease is stored in a holding tank 130. To rig down the equipment, pressure in the grease system is bled down using valve 128 and returned to holding tank 130. A level indicator (not shown) monitors the level of grease in the tank 130 as this is required to operate the grease inject 34. In addition, the speed and direction of the wireline 24 is required, as is the flow rate and cycles per minute of the pump 120 (122).

The second pump 122 may also be used to inject grease into the BOP 22 using conduit 132 which is coupled to a valve 134. This injects grease from the tank 130 into the BOP 22. Grease is used when the BOP 22 is operated to seal the small holes around the line 24 which are left open when the rubber seals of the BOP 22 close around it. The grease goes into these small holes and prevents the hydrocarbons from passing therethrough.

The tool catcher 36 is actuated by pulsing valve 136. This actuates a three-way, spring-loaded valve 138 to connect the catcher 36 to pressure P. The valve 138 is normally biased, by way of a spring, to connect the catcher 36 to holding tank 78. Again, a pressure transducer 142 monitors the pressure in the line to the catcher 36, and relays the signal back to the PC 52.

Two valves 144, 146 facilitate operation of tool trap 40. Operating valve 144 actuates a two-way valve 148 which connects pressure P to the tool trap piston 156, thereby closing the trap 40.

A flowmeter 150 is used to measure how much hydraulic oil has been pumped. The reading from the flowmeter tells the operator in the winchroom 42 (the winchman) if the trap 40 is currently open or closed. A certain amount of flow indicates that the trap 40 is open. To close the trap 40, valve 146 is operated to move the two-way valve 148 to connect the pressure P in the opposite direction, to the operating piston 156.

Pressure transducers 152, 154 are included in hoses 180, 182 which go to, and from, the operating piston 156 to allow the pressure in hoses 180, 182 to be monitored.

Operation of the BOP 22 is facilitated by a centrally-biased three-way valve 160. To operate the BOP 22, valve 162 is opened to move the three-way valve 160 to connect the pressure P to conduit 166. The pressure is measured by a transducer 168.

A flowmeter 170 is used to indicate the current status of the BOP 22 (ie whether it is open or closed), the meter 170 draining into tank 78. Conventionally, BOPs are provided with a visual indication of whether it is open or closed. However, an operator must be in the line of sight to see this indicator. The value read from the flowmeter 170 will give the operator located in the winchroom 42 (the winchman) an indication of the status of the BOP 22 without having to see the visual indicator.

The BOP 22 is deactuated by opening valve 164 which changes the position of the valve 160 so that hydraulic pressure P goes in the opposite direction. An accumulator 172 is charged up and its pressure retained by valve 174. A pressure transducer 176 monitors the pressure in this line. If air pressure is lost and the pressure P is lost, the BOP 22 may still be operated in an emergency by opening valve 174 and valve 160, manually.

The BOP 22 is generally used only in emergencies and the operation is not instantaneous. Thus it may not be necessary to operate the BOP 22 by remote control. It may be possible to reduce the cost of the pressure control apparatus by not incorporating this channel.

When the BOP 22 is closed, grease may need to be injected around the wireline 24. Pulsing the valve 178 injects grease from the tank 130 into the BOP 22. As a fail-safe addition, if the communications or electronics of the system fail, the valve 178 will be continually pulsed to inject grease into the BOP 22. If this does happen, a red light in the winchroom 22, on the screen of the PC for example, will alert the operator. It should be noted that all of the above described functions may be operated manually from the skid, in addition to remote control operation. Thus, in the event of a communications or electronics failure, operation of the entire system may revert to manual control.

All of the signals from the various transducers will be transmitted back to the PC 52 in the winchroom 42 for continual monitoring by an operator. This will allow the system parameters to be continually updated as conditions change. The signals from the transducers can be recorded at variable sampling rates if required.

The PC 52 may be a desktop or laptop PC. It will be preloaded with bespoke software. A standard control panel for the skid 50 may be reproduced on the screen with analogue gauges for easy reading.

As noted above, the system is modular and any number of channels may be controlled. If only the grease injection system is required to be remotely controlled, then only the grease pressure transducers and tank level monitor will be required, thereby reducing the costs. It may also be advantageous for the winchman (in the winchroom 42) to know if the tool has hit the flap of the tool trap 40, so this channel may also be added.

Thus, the present invention provides a wireline pressure control apparatus which may be operated by remote control, but has the facility to be operated manually also. The system can be automatically or manually controlled from a logging cab or winch unit, without the need for hydraulic hoses. It also maintains the flexibility of existing systems in that only an air line need be connected at the rig floor for power.

Furthermore, the system is completely modular and thus the customer may choose which modules they require. This will inevitably lead to a reduced cost for a tailored system which does not have all of the aforementioned components.

Although the above embodiment has been described with reference to a wireline pressure control skid, the system may be used to control a diesel-driven wireline grease intensifier skid.

Modifications and improvements may be made to the foregoing, without departing from the scope of the present invention.

What is claimed is:

1. A pressure control apparatus comprising a first portion having at least one fluid pressure outlet and at least one controlling mechanism to facilitate control of the fluid pressure outlet, wherein the controlling mechanism is operable by a control system at least a portion of which is located remote from the first portion, and wherein at least one fluid pressure outlet is coupled to wireline pressure control equipment for controlling pressure in a well, the wireline pressure control equipment including a wireline grease inject having an operating pressure, wherein the apparatus is capable of obtaining pressure signals from the well and the apparatus is also capable of automatically adjusting the operating pressure of the wireline grease inject so that it operates at a higher pressure than the well pressure.

2. A pressure control apparatus according to claim 1, wherein the controlling mechanism is operable by a computer controlled system.

3. A pressure control apparatus according to claim 2, wherein the at least one controlling mechanisms comprise variable settings to enable variation of the operation of the at least one controlling mechanisms, and wherein the computer is pre-loaded with software which permits a user to alter the settings of the at least one controlling mechanisms.

4. A pressure control apparatus according to claim 3, wherein the software instructs the computer to display gauges on a visual display unit (VDU) which relate to the settings of the control mechanism.

5. A pressure control apparatus according to claim 4, wherein the software provides for periodic sampling of the readings of the gauges.

6. A pressure control apparatus according to claim 1, the wireline pressure control equipment further including apparatus selected from one of the group consisting of:

i) flow tube and BOP grease injection system;

ii) BOP, tool trap, tool catcher and line wiper;

iii) Stuffing box;

iv) Master valve; and v.) Downhole safety valve.

7. A pressure control apparatus according to claim 6, wherein the controlling mechanisms are divided into a plurality of channels and each channel operates an item of pressure equipment.

8. A pressure control apparatus according to claim 1, wherein the control system comprises a first controller located remote from the first portion, a second controller located at the first portion, and a telemetry system for transmitting control signals from the first controller to the second controller.

9. A pressure control apparatus according to claim 8, wherein the first controller comprises a computer.

10. A pressure control apparatus according to claim 8, wherein the second controller comprises a programmable logic controller (PLC).

11. A pressure control apparatus according to claim 8, wherein the telemetry system comprises a transmitter unit electrically connected to the first controller, a receiver unit electrically connected to the controlling mechanisms, and a transmission medium for communicating signals between the transmitter and receiver.

12. A pressure control apparatus according to claim 11, wherein the transmission medium comprises one or more cables.

13. A pressure control apparatus according to claim 11, wherein the transmission medium is air.

14. A pressure control apparatus according to claim 1, wherein the first portion comprises a frame and further includes any one of the group consisting of pumps, tanks, control valves and hoses.

15. A pressure control apparatus according to claim 14, wherein the frame comprises a pressure control skid.

16. A pressure control apparatus according to claim 14, wherein the frame is a diesel-driven intensifier skid.

17. A pressure control apparatus according to claim 1, wherein there is provided a plurality of controlling mechanisms to facilitate control of a plurality of fluid pressure outlets.

18. A pressure control apparatus according to claim 17, wherein the controlling mechanisms operate using low power electronics.

19. A pressure control apparatus according to claim 17, wherein the fluid pressure outlets are coupled to pressure operated equipment.

20. A pressure control apparatus according to claim 17, wherein the controlling mechanisms are divided into a plurality of channels.

21. A pressure control apparatus according to claim 17, wherein the controller mechanisms are provided with full manual control.

22. A pressure control apparatus according to claim 1, wherein the controlling mechanism is actuated by at least one air valve.

23. A pressure control apparatus according to claim 22, wherein the air valves are piezo electric air valves.

24. A pressure control apparatus according to claim 22, wherein the air valves facilitate operation of a hydraulic circuit.

25. A method of controlling wireline pressure control equipment used in the exploration, production and/or exploitation of hydrocarbons, the wireline pressure control equipment being for controlling pressure in a well and including a wireline grease inject having an operating pressure, the method comprising locating a first portion of a pressure control apparatus in relatively close proximity to the said wireline pressure control equipment, where the first portion has at least one fluid pressure outlet coupled to the said wireline pressure control equipment and at least one controlling mechanism to facilitate control of the fluid pressure outlet, and locating a second portion of the pressure control apparatus in relatively spaced proximity from the said wireline pressure control equipment, where the second portion has a control system which operates the controlling mechanism of the first portion, wherein the method further comprises obtaining pressure signals from the well and automatically adjusting the operating pressure of the wireline grease inject so that it operates at a higher pressure than the well pressure.

26. A method according to claim 25, further comprising a telemetry system for transmitting control signals between the control system of the second portion and the controlling mechanism of the first portion.

27. A method according to claim 25, wherein the first portion comprises a frame and further includes any one of the group consisting of pumps, tanks, control valves and hoses.

28. A method according to claim 25, wherein the wireline pressure control equipment to be controlled is selected from one of the group consisting of:

i) flow tube and wireline BOP grease injection system;

ii) wireline BOP, tool trap, tool catcher and line wiper;

iii) Stuffing box;

iv) Master valve; and v) Downhole safety valve.

29. A pressure control apparatus comprising a first portion having at least one fluid pressure outlet and at least one controlling mechanism to facilitate control of the fluid pressure outlet, wherein the controlling mechanism is operable by a control system at least a portion of which is located remote from the first portion, and wherein at least one fluid pressure outlet is coupled to wireline pressure control equipment for controlling pressure in a well, the wireline pressure control equipment including a wireline grease inject having an operating pressure, wherein the controlling mechanism is operable by a computer controlled system, wherein the at least one controlling mechanisms comprise variable settings to enable variation of the operation of the at least one controlling mechanisms, and wherein the computer is preloaded with software which permits a user to alter the settings of the at least one controlling mechanisms, wherein the software instructs the computer to display gauges on a visual display unit (VDU) which relate to the settings of the control mechanism.

30. A pressure control apparatus according to claim 29, wherein the software provides for periodic sampling of the readings of the gauges.

31. A pressure control apparatus comprising a first portion having at least one fluid pressure outlet and at least one controlling mechanism to facilitate control of the fluid pressure outlet, wherein the controlling mechanism is operable by a control system at least a portion of which is located remote from the first portion, and wherein at least one fluid pressure outlet is coupled to wireline pressure control equipment for controlling pressure in a well, the wireline pressure control equipment including a wireline grease inject having an operating pressure, wherein the controlling mechanism is actuated by at least one air valve.

32. A pressure control apparatus according to claim 31, wherein the air valves are piezo electric air valves.

33. A pressure control apparatus according to claim 31, wherein the air valves facilitate operation of a hydraulic circuit.

* * * * *